US006779791B2

(12) United States Patent
Kawamura et al.

(10) Patent No.: US 6,779,791 B2
(45) Date of Patent: Aug. 24, 2004

(54) PAPER-LIKE MATERIALS PROCESSING APPARATUS

(75) Inventors: Shigemi Kawamura, Kanagawa-ken (JP); Naruaki Hiramitu, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 108 days.

(21) Appl. No.: 10/232,381

(22) Filed: Sep. 3, 2002

(65) Prior Publication Data

US 2003/0057637 A1 Mar. 27, 2003

(30) Foreign Application Priority Data

Sep. 21, 2001 (JP) ..... P2001-290257

(51) Int. Cl.[7] ..... R65H 7/02
(52) U.S. Cl. ..... 271/228; 271/258.01; 209/534
(58) Field of Search ..... 271/227, 228, 271/256, 258.01, 265.01, 270; 209/534, 919, 540, 541, 545

(56) References Cited

U.S. PATENT DOCUMENTS

| | | | | | |
|---|---|---|---|---|---|
| 4,877,234 | A | | 10/1989 | Mandel | |
| 5,078,384 | A | * | 1/1992 | Moore | 271/228 |
| 5,094,442 | A | * | 3/1992 | Kamprath et al. | 271/227 |
| 5,169,140 | A | * | 12/1992 | Wenthe, Jr. | 271/228 |
| 5,195,736 | A | * | 3/1993 | Ishidate | 271/22 |
| 5,219,159 | A | * | 6/1993 | Malachowski et al. | 271/228 |
| 5,381,021 | A | * | 1/1995 | Polidoro | 250/559.37 |
| 5,443,257 | A | * | 8/1995 | Sakamori | 271/228 |
| 5,697,609 | A | * | 12/1997 | Williams et al. | 271/228 |
| 5,755,437 | A | * | 5/1998 | Ek | 271/227 |
| 6,053,494 | A | * | 4/2000 | Baskette et al. | 271/251 |
| 6,059,284 | A | * | 5/2000 | Wolf et al. | 271/227 |
| 6,059,285 | A | * | 5/2000 | Suga et al. | 271/228 |
| 6,062,369 | A | * | 5/2000 | Negishi | 194/207 |
| 6,168,153 | B1 | * | 1/2001 | Richards et al. | 271/227 |
| 6,173,952 | B1 | * | 1/2001 | Richards et al. | 271/228 |
| 6,234,294 | B1 | * | 5/2001 | Defeo et al. | 194/207 |
| 6,453,149 | B1 | * | 9/2002 | Dobbertin et al. | 399/388 |
| 6,533,268 | B2 | * | 3/2003 | Williams et al. | 271/228 |
| 6,550,621 | B2 | * | 4/2003 | Fukatsu et al. | 209/534 |
| 6,575,458 | B2 | * | 6/2003 | Williams et al. | 271/228 |
| 6,578,844 | B2 | * | 6/2003 | Acquaviva et al. | 271/228 |
| 6,581,929 | B2 | * | 6/2003 | Hiramitsu | 271/228 |
| 6,634,521 | B1 | * | 10/2003 | Hwang | 221/228 |

FOREIGN PATENT DOCUMENTS

| | | | | |
|---|---|---|---|---|
| EP | 0 736 473 A2 | | 10/1996 | |
| EP | 1 188 699 A2 | | 3/2002 | |
| JP | 06191684 A | * | 7/1994 | B65H/9/10 |

OTHER PUBLICATIONS

European Search Report in reference to EP 02 25 6097 dated Mar. 19, 2004.

* cited by examiner

*Primary Examiner*—Donald P. Walsh
*Assistant Examiner*—Matthew J. Kohner
(74) *Attorney, Agent, or Firm*—Pillsbury Winthrop LLP

(57) ABSTRACT

A paper-like materials processing apparatus brings the speed in the direction for conveying paper-like materials by a shift correction roller for moving paper-like materials at an angle based on a shift amount crossing the conveying direction of paper-like material agree with the conveying speed by a conveying mechanism.

11 Claims, 13 Drawing Sheets

PAPER-LIKE MATERIALS PROCESSING APPARATUS

CROSS REFERENCE TO RELATED APPLICATIONS

This application is based upon and claims the benefit of priority from the prior Japanese Application No. 2001-290257, filed on Sep. 21, 2001; the entire contents of which are incorporated herein by reference.

BACKGROUND OF THE INVENTION

The present invention relates to a paper-like materials processing apparatus which processes paper-like materials taken out on a conveying path by detecting their features and, more particularly, to a banknote receiving machine which takes out banknotes one by one on a conveying path, conveys, detects features such as kinds and directions of banknotes, uniformly arranges the front/back and the top/bottom and accumulates them by kind.

A banknote receiving apparatus is so far known as a paper-like materials processing apparatus. For example, plural kinds of banknotes are collectively inserted into this banknote receiving apparatus in mix and these inserted banknotes are taken out on a conveying path one by one, its feature is detected and the front/back and the top/bottom are arranged uniformly and accumulated by kind.

However, a banknote size differs according to kind and the feature position also differs depending on kind. Therefore, depending on the position of a detecting portion arranged for detecting banknote features, the detecting portion may not oppose to the feature portion and there may be banknotes of which features cannot be detected precisely. Because of this, in a conventional apparatus, many detectors are provided in the cross direction of a conveying path so that the features of banknotes are detected precisely even when the feature portion passes any position. Accordingly, there were such problems that it became necessary to provide many detectors, the structure of apparatus was complicated and the manufacturing cost was increased.

Furthermore, in a conventional apparatus there were such problems that when the banknote conveying posture was tilted to the conveying path (skewed) and/or one-sided (shifted) to the cross direction of the conveying path, banknotes were conveyed on the conveying path in such a improper posture and the feature detecting accuracy of banknotes by the detector further dropped.

So, as disclosed in U.S. patent application Ser. No. 09/899,851 (Filed on Jul. 9, 2001), an apparatus to correct the shift of banknotes before correcting the skew by correction rollers is proposed.

That is, as a method to correct the banknotes that are being conveyed in the state shifted by a certain distance from the conveying center in a conveying device, the Swing Arm Roller (hereinafter, abbreviated as SAR) method is proposed. In this SAR method, the rotary shaft (the driving shaft) of the SAR is set vertically to the conveying plane at the conveying center of the apparatus. At the time of shift correction, this SAR is held around the rotary shaft at a certain angle and corrects the shift of banknotes when passing the SAR. So, the SAR is set at an angle to the conveying direction so that the shifted amount of banknotes becomes zero (0) at the moment when banknotes pass the SAR and become free from the force from the SAR.

That is, in this method for correcting the banknote position shift, the banknotes shift is corrected by tilting the, correction arm by a measured amount of the shift (distance) of the banknote position from the banknote center added with the length of banknotes in the shorter direction. This position shift is corrected while maintaining a skew angle.

However, according to this proposed method, the shift is corrected by continuously rotating the correction arm roller at a fixed speed. In this method, when the correction arm is tilted, the speed of the correction arm roller in the conveying direction drops according to a tilting angle of the correction roller and there is such a problem that when a banknote is taken in the correction arm roller, the speed drops in a moment, the collision phenomenon is caused and the posture (tilt) of a banknote may possibly be changed.

In addition, the posture and skew of each of the banknotes taken in the posture correction device are corrected while the swing angles of the position shift correction arm and the skew correction arm are swung to proper swing values in order. Each of the correction arms has an actual swing time and the driving operation of the correction arms must be finished to the correction angle before a banknote to be corrected enters into the correction arm. The correction arms need a time for the driving operation and it is limited to correct two sheets of banknote taken out closely. Banknotes closely taken in closely in excess of this limitation are not corrected and it is therefore necessary to prohibit the correction. When the correction arms are kept at the same positions, there was a problem that the position shift might be more expanded if the correction arms are in the tilted state.

BRIEF SUMMARY OF THE INVENTION

An object of the present invention is to provide a paper-like materials processing apparatus that is capable of bringing the velocity of the position correcting roller for moving paper-like materials at an angle based on the amount of position shift crossing the conveying direction of paper-like material in accord with the conveying velocity by the conveying means and preventing the posture of paper-like materials from changing by the position correction roller.

According to the present invention, a paper-like materials processing apparatus is provided. This paper-like materials processing apparatus comprises: conveying means for conveying paper-like materials along a conveying path; first detecting means for detecting a shift amount of paper-like materials being conveyed by the conveying means in the direction crossing the conveying direction; moving means provided at the latter stage of the detecting means on the conveying path, provided with a supporting arm supported at the center of the conveying path and shift correction rollers proved to this supporting arm for moving paper-like materials being conveyed by the conveying means in the direction crossing the conveying path; first calculating means for calculating a driving angle of the support arm based on a shift amount from a prescribed position detected by the first detecting means; second calculating means for calculating number of revolutions of the shift correction rollers so that a speed component out of the peripheral speed of the shift correction rollers in the conveying direction of paper-like materials becomes equal to a conveying speed by the shift correction rollers; support arm rotating means for rotating the support arm of the moving means based on the driving angle calculated by the first calculating means; correction roller rotating means for rotating the shift correction rollers of the moving means based on the number of revolutions calculated by the second calculating means; and first correcting means for correcting the shift from a prescribed position of the paper-like materials by moving the paper-like materials that are conveyed by the conveying means in the direction crossing the conveying path in the state with the support arm of the moving means rotated in the direction crossing the conveying path by the support arm rotating means and in the state with the shift correction rollers of the moving means being rotated at the number of revolutions by the correction roller rotating means.

Further, according to the present invention, a paper-like materials processing apparatus is provided. This paper-like materials processing apparatus comprises: conveying means for conveying paper-like materials in order consecutively along a conveying path; first detecting means for detecting shift amounts of preceding paper-like materials conveyed in order by the conveying means to either left and right directions crossing the conveying direction, skew amounts in the direction crossing the conveying direction of paper-like materials, and a gap of preceding and current paper-like materials; first correcting means for correcting the shift and skew in the direction crossing the conveying direction based on the shift and skew amounts detected by the detecting means for the preceding and current paper-like materials when a gap between the preceding and current paper-like materials detected by the first detecting means is more than a prescribed gap; and prohibiting means for prohibiting the correction of shift and skew for the preceding and current paper-like materials being conveyed by the conveying means when a gap between the preceding and current paper-like materials detected by the first detecting means are less than the prescribed gap.

DETAILED DESCRIPTION OF THE INVENTION

Figure 1:
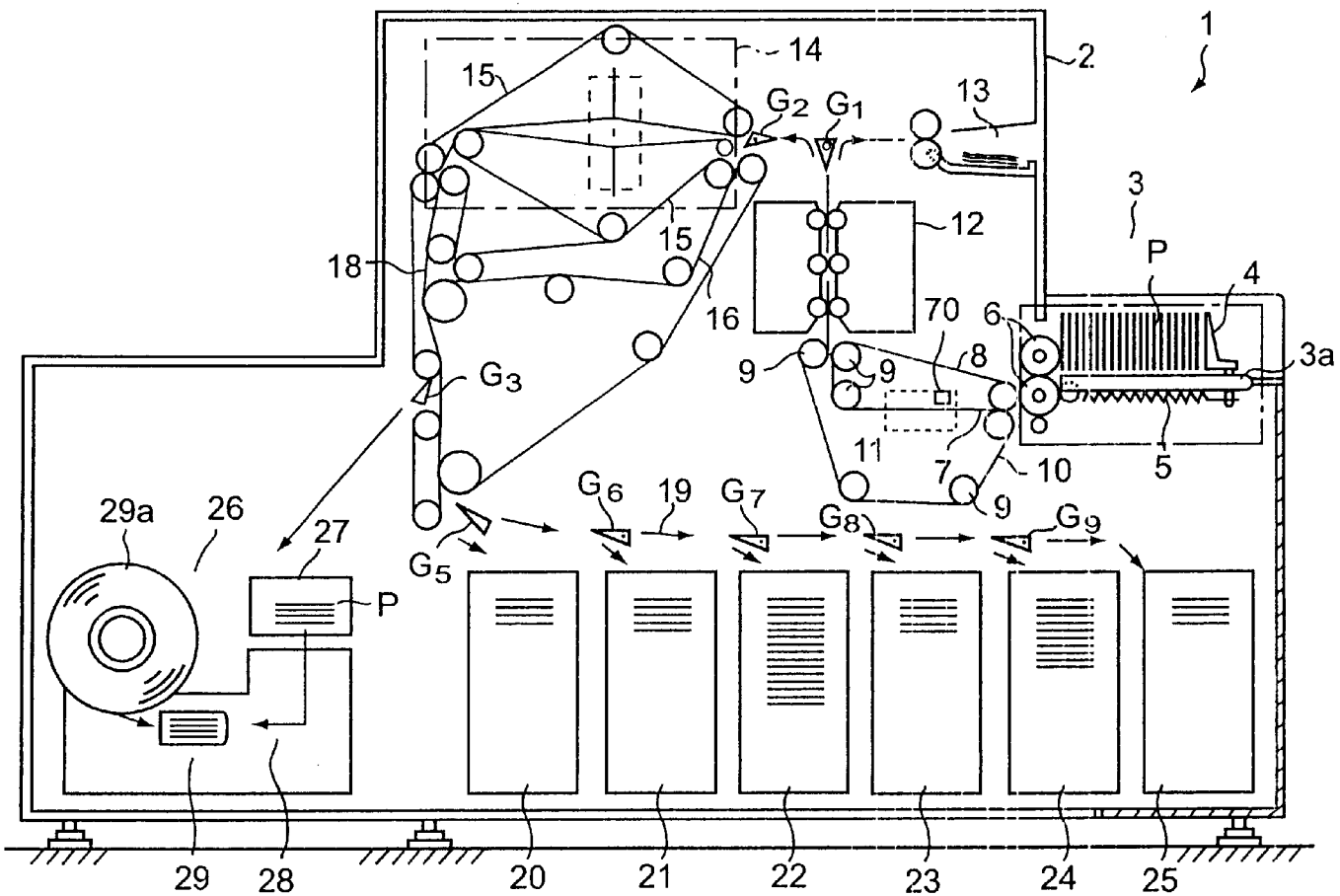
FIG. 1 is a schematic diagram showing the internal structure of a banknote receiving machine for explaining an embodiment of the present invention.

A preferred embodiment of the present invention will be described below in detail referring to the drawings.

FIG. 1 shows a schematic structure of a banknote receiving machine 1 (a paper-like document processing apparatus) involved in the embodiment of the present invention. The banknote receiving machine 1 receives banknotes P in plural kinds of money and different sizes) inserted collectively in mix, classifies and accumulates by uniformly arranging the front/back, and has a function to band a specific kind of banknote only for every prescribed number of sheets with a paper strip.

The banknote receiving machine 1 has a housing 2 that is the outer block of the machine. In the stepped part at the right side of the housing, there is provided an insert port 3 into which plural banknotes P in the state accumulated and stacked in the face direction are inserted collectively in the erected state. Banknotes P have the front and reverse sides and the top and bottom edges extending along the longitudinal direction, and are inserted into the insert port 3 in the posture of the top or bottom edge facing downward. The insert port 3 has a stage 3*a* that aligns all banknotes P by contacting the top or bottom edges of the banknotes. At the right side of the insert port 3 in FIG. 1, there is provided a backup plate 4 in the erected state in the vertical direction to the stage 3*a*. This backup plate 4 is provided movably in the leftward direction along the stage 3*a* by the force of a spring 5.

Plural banknotes P inserted into the insert port 3 in the erected state are pressed in the face direction of the banknotes by the backup plate 4 and moved leftward in the figure. Hence, the banknotes P at the left end are pressed against a set of take-out rollers (the take-out port) arranged in the state vertically adjacent each other at the left side. When the take-out rollers 6 are rotated in the prescribed direction, the banknotes inserted into the insert port 3 in the erected state are taken out on a conveying path 7 in order from the banknote P at the left end. The banknotes P taken out on the conveying path 7 are conveyed in the shorter direction with the top or the bottom in the lead. At this time, the front and reverse sides of banknotes are not uniformly arranged. In this embodiment, the banknotes P are taken out downward from the insert port 3.

The conveying path 7 is defined by conveying belts 8 and 10 extended above and below the conveying path 7 to endlessly run along the conveying direction. The conveying belts 8 and 10 are routed through plural rollers provided in the cross direction (the banknote surface direction). On the conveying path 7, there is provided a posture correction device 11(will be explained later in detail) for automatic correcting the shift and the skew of the taken out banknotes P.

Ahead the conveying path 7 that is bent upward by the conveying belts 8 and 10, there is a detector for detecting features of banknotes P such as kind, front/back, top/bottom, presence of dirt, tear or break. The detector 12 reads various kinds of information from the surfaces of banknotes P conveyed on the conveying path 7, logically calculates read information, compares them with reference information, and detects such features of banknotes P described above.

Banknotes P are inserted into the insert port 3 in the state of front/back and top/bottom not uniformly arranged and therefore, when taken out on the conveying path 7, the front/back and top/bottom of the banknotes are in the not uniformly arranged state. So, the front/back and top/bottom of the banknotes P in plural kinds passing through the detector 12 are not uniformly arranged.

On the conveying path 7 extended to the downstream side of the detector 12, there are provided plural gates G1–G9 for selectively switching the conveying direction of banknotes P based on the result of detection by the detector 12.

Banknotes judged cannot be processed at the latter stage, for example, two sheets are taken, largely skewed more than a prescribed level, damaged and forgery banknotes judged not proper for circulation (not limited to banknotes) are conveyed rightward through the gate G1 and discharged into a rejection box 13. This rejection box 13 is accessible from the outside of the housing 2.

On the other hand, banknotes P judged proper for process by the detector 2 are conveyed leftward to the gate G2 via the gate G1. Banknotes passed through the gate G1 are in the state wherein the front/back and top/bottom are not uniformly arranged as described above. When these banknotes P pass through a front/back reversing mechanism 14 selectively, the front and back are uniformly arranged, classified and stacked by kind of money. In this embodiment, all banknotes P are stacked basically with the front upward.

The conveying path at the downstream side of the gate G2 is branched into two directions. The conveying direction of banknotes P can be selectively switched into two directions by selectively switching the gate G2 between 2 positions.

On one of the conveying path branched at the downstream side of the gate G2, the front/back reversing mechanism 14 (the front/back reversing portion) is provided for reversing the front/back of banknotes P. The conveying path passing through this front/back reversing mechanism 14 is twisted by 18° C. around the center shaft from its entrance to the exit and is formed to a twisted conveying path 14*a*. Along the twisted conveying path 14*a*, a pair of conveying belts 15 and 15 are provided in the twisted state with both surfaces contacted each other. Further, the other conveying path branched at the downstream side of the gate G2 is a conveying path 16 for only passing banknotes P.

The front/back of banknotes P sorted by the gate G2 and conveyed through the twisted conveying path 14*a* are reversed here.

The banknotes passed through the front/back reversing mechanism 14 and the banknotes P conveyed on the conveying path 16 without passing the front/back reversing mechanism 14 are conveyed into the gate G3 via a joining portion 18. The length of the conveying path 16 is set so that a processing time of the banknotes P conveyed to the joining portion 18 after passing the gate G2 via the front/back reversing mechanism 14 and a conveying time of the banknotes P to the joining portion 18 on the conveying path 16 become equal to each other. Thus, the banknotes P conveyed through the front/back reversing mechanism 14 and the banknotes P conveyed on the conveying path 16 will pass the joining portion 18 at the same timing and all banknotes P can be processed at the same condition irrespective of the type of process.

The conveying path at the downstream side of the gate G3 is branched into two directions and the conveying direction of banknotes P can be selectively changed to two directions by selectively switching the gate G3 between two positions.

One of the conveying path branched rightward in the figure at the downstream side of the gate G3 forms a horizontal conveying path 19 extending almost in the horizontal direction above plural accumulating portions 20–25. Above the horizontal conveying path 19, five gates G5–G9 are provided for sorting and accumulating conveyed banknotes P into one of six accumulating portions 20–25.

Banknotes P selectively sorted by the gate G5 at the most upper stream side of the horizontal conveying path 19 are accumulated in the accumulating portion 20. Banknotes P selectively sorted by the gate G6 are accumulated in the accumulating portion 21. Banknotes P selectively sorted by the gate G7 are accumulated in the accumulating portion 22. Banknotes P selectively sorted by the gate G8 are accumulated in the accumulating portion 23. Banknotes selectively sorted by the gate G9 are accumulated in the accumulating portion 24 or 25.

At the position branched leftward at the downstream side of the gate G3, an accumulating portion 27 of a banding device 26 is provided. This banding device forms a bundle of banknotes P by stacking, for example, 100 sheets and binding them with a paper strip. Banknotes of specific kind of money assigned for banding with a paper strip are sent (accumulated) to the accumulating portion 27 according to a rule that is described later. On the other hand, banknotes P other than the banknotes of specific kind of money are accumulated in the accumulating portions 20–25 described above.

The banknotes P accumulated in the accumulating portion 27 through the gate G3 are sent into a banding portion 29 by a supply portion 28 and banded with a paper strip supplied from a strip supply portion 29*a*. The bundles of banknotes banded for every prescribed number of banknotes are carried out to the outside of the apparatus by a conveyor (not shown).

Further, the banding portion 29 receives banknotes P in prescribed number of sheets accumulated in the accumulating portion 27 and forms a bundle by banding banknotes in prescribed number of sheets by winding a paper strip on the banknotes along its shorter direction.

Figure 2:
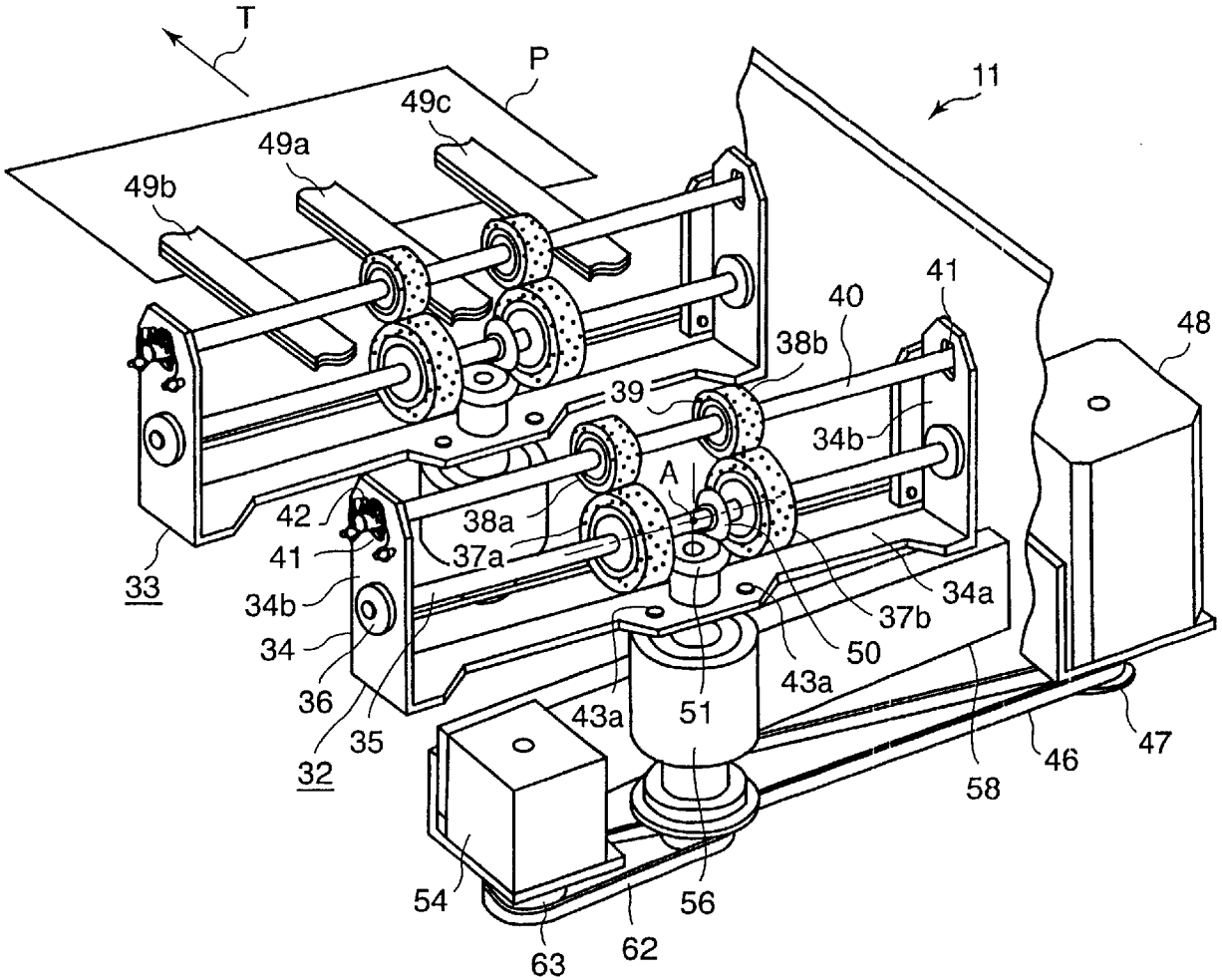
FIG. 2 is a perspective view showing a posture correction device incorporated in the banknote receiving machine shown in FIG. 1.
Figure 3:
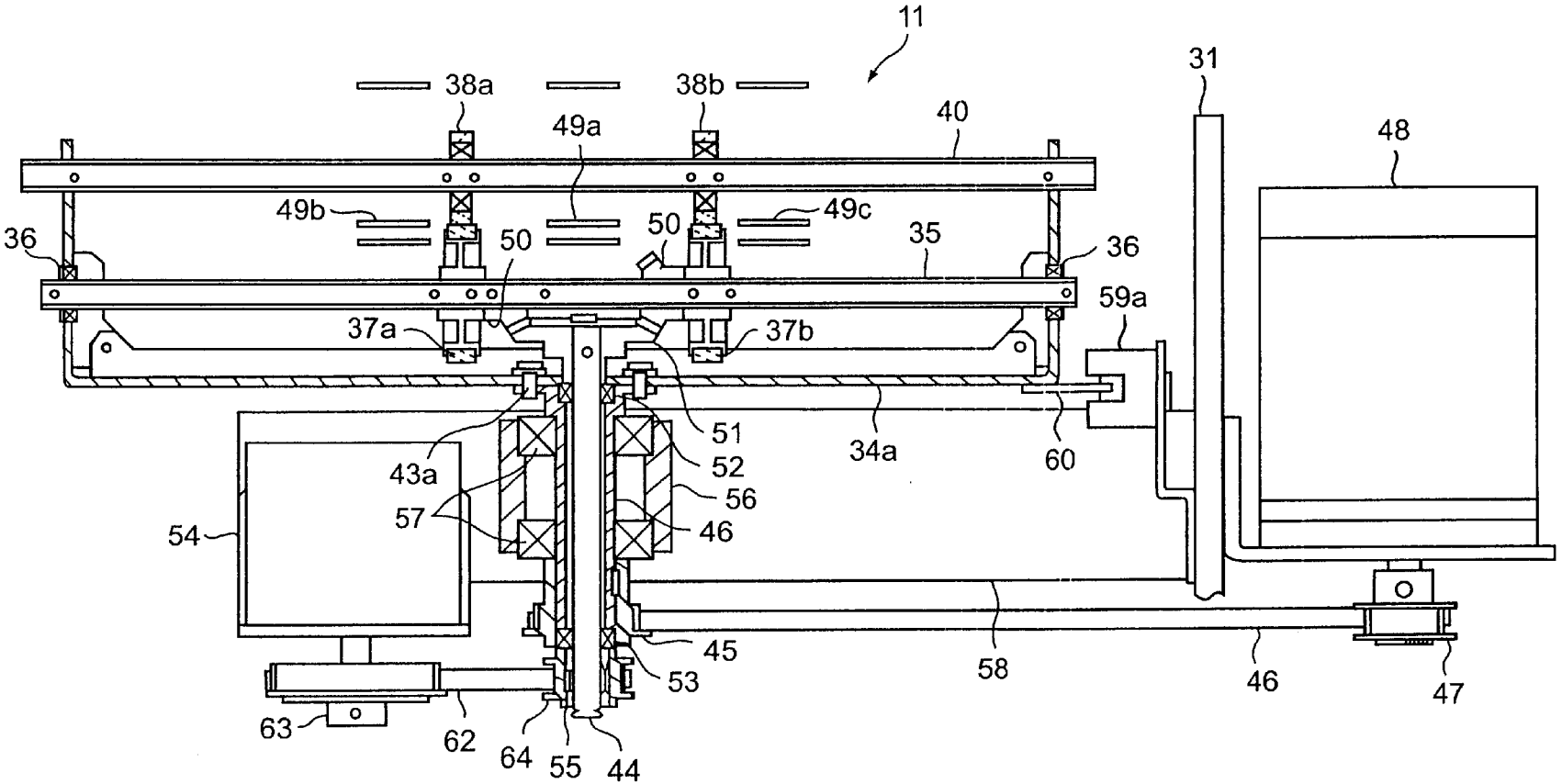
FIG. 3 is a sectional view showing the internal structure of the posture correction device shown in FIG. 2.

Next, the posture correction device 11 described above will be explained in detail referring to FIG. 2 through FIG. 4.

The posture correction device 11 has a posture detecting sensor 70, first and second correction mechanisms 32 and 33 along the conveying direction of banknotes P (the direction shown by the arrow T in the figures). The posture detecting sensor 70 detects the conveying state of banknotes P conveyed into the posture correction device 11 through the conveying path 7. The first and second correction mechanisms 32 and 33 are mounted on a base plate 31 erected at the rear side of the apparatus along the conveying path 7. The first and second correction mechanisms 32 and 33 are almost in the same structure. Therefore, the first correction mechanism 32 will be explained representatively and the explanation of the second correction mechanism 33 will be omitted here.

The first correction mechanism 32 has a support frame 34 with both ends of long and narrow plate member bent by nearly right angle to the same side. That is, the support frame 34 has a frame base portion 34*a* that is longer than the longer side of largest banknote conveyed on the conveying path 7 and two side walls 34*b* and 34*b* bent nearly by a right angle from both sides of the frame base portion 34*a*.

Between two side walls 34*b* and 34*b*, a drive shaft 35 that is a support arm (an correction arm) is put over via bearings 36 and 36. The drive shaft 35 is provided with two rubber rollers (correction arm rollers) 37*a* and 37*b*. On the outer surfaces of two rubber rollers 37*a* and 37*b* are formed with rubber material in order to increase a friction force. Above these rubber rollers 37*a* and 37*b*, corresponding two rubber rollers 38*a* and 38*b* are kept in contact with them. These rubber rollers 38*a* and 38*b* are installed to the shaft 40 via a bearing 39. Both ends of the shaft 40 are fitted into a slot 41 formed on the side walls 34*b* and 34*b* of the support frame 34 and pressed downward by a spring 42 provided on the outside of the side walls 34*b* and 34*b*. That is, two rubber rollers 38*a* and 38*b* are pressed against the corresponding two rubber rollers 37*a* and 37*b*, and four rubber rollers 37*a*, 37*b*, 38*a* and 38*b* function as correction rollers.

The rubber rollers 37*a*, 37*b*, 38*a* and 38*b* are nested between 3 pairs of conveyor belts 49*a*, 49*b* and 49*c* extending along the conveying path 7 by passing through the posture correction device 11. That is, the rubber roller pair 37*a* and 38*b* are arranged between the first and second conveyor belt pair 49*a*, 49*b*, and the rear side roller pair 37*b* and 38*b* of the apparatus are arranged between the first and the third conveyor belt pair 49*a* and 49*c*.

Further, three sets of conveyor belt pair 49*a*, 49*b* and 49*c* are provided over the overall length of the conveying path 7 extending passing through the banknote receiving machine 1. These conveyor belt pair are opposed to clamp the conveying path 7 from the upper and lower sides and wound round the rollers (not shown) and function as the conveying portion of this invention.

More in detail, the first conveyor belt pair 49*a* at the center are extending on the center line 7*a* of the conveying path 7 at the upper and lower surface sides of the conveying path 7. They are contacted each other at the faces by way of the conveying path 7, and defines the upper and lower sides of the conveying path 7 jointly with the second and third conveyor belt pair 49*b* and 49*c*. Further, two rubber rollers 37*a* and 37*b* are arranged at the under surface side of the conveying path 7 and other two rubber rollers 38*a* and 38*b* are arranged at the top side of the conveying path 7, and the conveying path 7 is defined between these two sets of rubber rollers 37*a*, 37*b*, 38*a* and 38*b*.

To a drive shaft 35 installed in the direction crossing the conveying path 7 under its lower side, a bevel gear 50 is installed. This bevel gear 50 is provided between the rubber rollers 37*a* and 37*b* and engaged with another bevel gear 51. The bevel gear 51 is fixed to the top of a drive shaft 44 that is extended almost in the vertical direction as shown in detail in FIG. 3. Further, the top of the drive shaft 44 is facing the central portion of the drive shaft 35 equipped with the rubber rollers 37*a* and 37*b*.

The drive shaft 44 is inserted into a cylindrical shaft 43 provided to it and is held rotatably by an upper bearing 52 and a lower bearing 53. The lower bearing 53 is installed at the inside of a pulley 45 that is fixed to the cylindrical shaft 43. Further, a pulley 64 is installed near the lower end of the drive shaft 44 via a one-way clutch 55. The pulley 64 is connected with the rotary shaft of a stepping motor 54 via a belt 62 and a pulley 63.

When the stepping motor 54 is driven to rotate, a driving force is transmitted to the drive shaft 44 via the plley 63, the belt 62 and the pulley 64 and the drive shaft 44 is rotated. The drive shaft 44 rotates only in one direction by the action of the one-way clutch 55. When the drive shaft is rotated in a prescribed direction, a bevel gear 51 attached to its top is rotated and the drive shaft 35 is rotated via the bevel gear 50. When the drive shaft 35 is rotated, two rubber rollers 37*a* and 37*b* are rotated and two rubber rollers 38*a* and 38*b* that are contacted under pressure to these rubber rollers 37*a* and 37*b* are also rotated. Thus, when four rubber rollers 37*a*, 37*b*, 38*a* and 38*b* are rotated, a banknote P is clamped in two nips between the rubber rollers and conveyed along the conveying path 7. Further, the force of the spring 42 is set so that the banknote clamping force of the rubber rollers 37*a*, 37*b*, 38*a* and 38*b* of the posture correction device 11 becomes stronger than the banknote clamping force of the conveyor belts 49*a*–49*c*.

On the other hand, the cylindrical shaft 43 is held rotatably in a nearly cylindrical housing 56. The top of the cylindrical shaft 43 is fixed to the central portion of the frame base portion 34*a* of the support frame 34 by two screws 43*a*. To the pulley 45 fixed at the lower end portion of the cylindrical shaft 43, the rotary shaft of the stepping motor 48 is connected via a belt 46 and a pulley 47. The housing 56 holding the cylindrical shaft 43 rotatably is fixed to the base plate 31 via a nearly rectangular plate 58. This plate 58 is fixed to the base plate 31 in the cantilever state.

Further, there is provided a sensor 59*a* on the base plate 31 for detecting the home position of the first correction mechanism 32. The support frame 34 is provided with a detected member 60 for shading the light of the sensor 59*a* in the rotation projecting from the frame. That is, when the light from the sensor 59*a* is shaded by the detected member 60, the stepping motor 48 is stopped to run and the first correction mechanism 32 is arranged at the home position. The home position refers to the posture where the rotary shafts of the rubber rollers 37*a*, 37*b*, 38*a* and 38*b* become orthogonal to the conveying direction.

Figure 4:
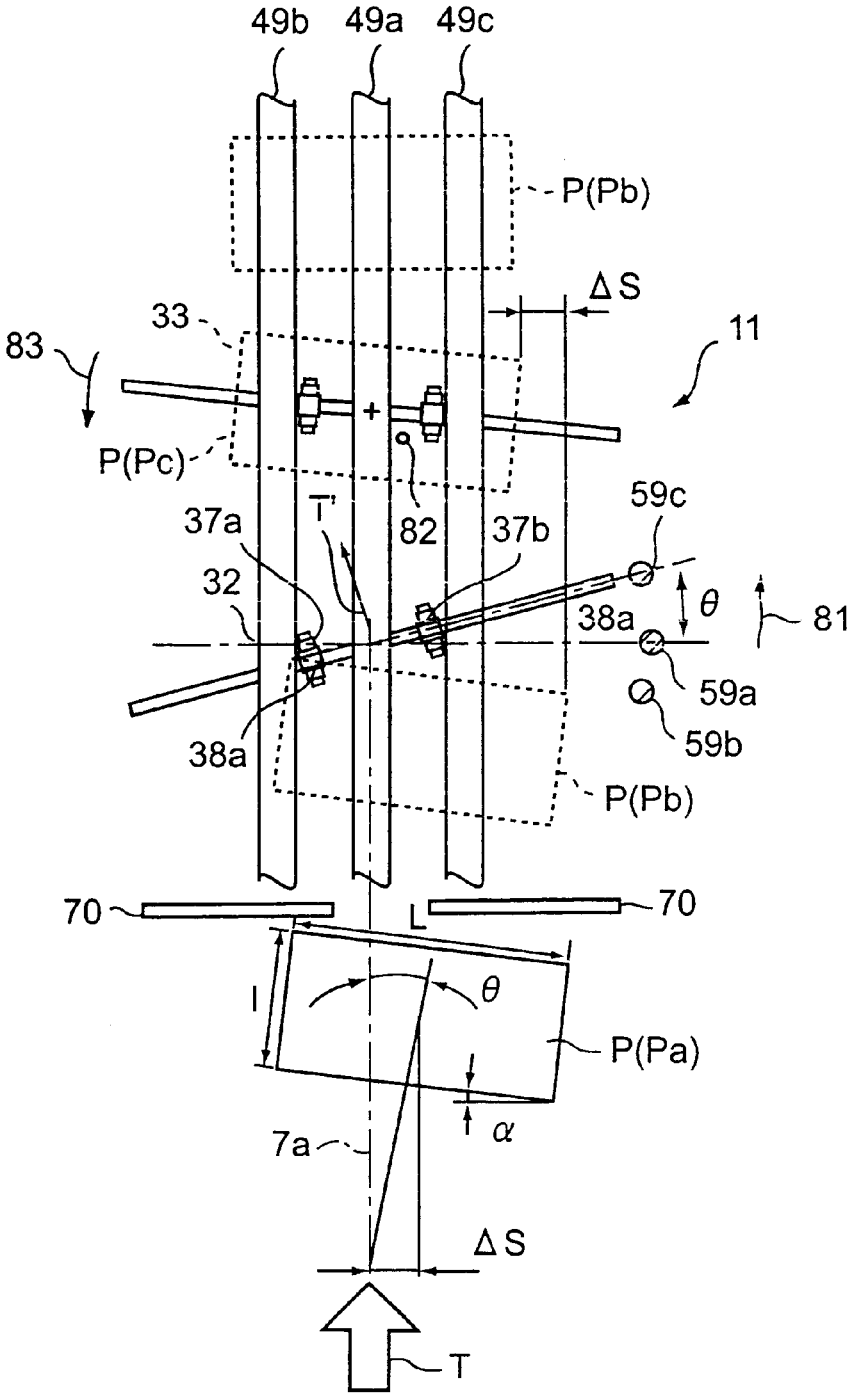
FIG. 4 is a plan view for explaining the structure of the posture correction device.

Further, two sensors 59*b* and 49*c* are provided on the base plate 31 in addition to the sensor 59*a* for detecting the detected member 60 when the first correction mechanism 32 rotates by a prescribed angle in both directions from the home position (SEE FIG. 4). These two sensors 59*b* and 59*c* are provided for detecting the run out position of the first correction mechanism 32. The run out position refers the positions of both ends of the rotating range of the first correction mechanism 32. Further, these three sensors 59*a*. 59*b* and 59*c* are composed of photo-interrupters, etc. that are turned on/off when the light is intercepted by the detected member 60.

Then, when the stepping motor 48 is driven to rotate, the driving force is transmitted via the pulley 47, the belt 46 and the pulley 45 and the cylindrical shaft 43 is rotated. When the cylindrical shaft 43 is rotated, the support frame 34 fixed to the top of the cylindrical shaft 43 is rotated; that is, the drive shaft 35 of the first correction mechanism 32 is rotated and the directions of the rubber rollers 37*a*, 37*b*, 38*a* and 38*b* are changed. Further, the rotating position of the drive shaft 35 of the first correction mechanism 32 is adjusted to an optional position by controlling the number of steps of the stepping motor 48 from the position that is a home position when the central sensor 59*a* detects the detected member 60.

On the conveying path 7 of the second correction mechanism 33, a sensor 82 is provided. This sensor 82 is for detecting a timing that the leading edge of a banknote P passed through the first correction mechanism 32 passes the sensor 82; that is, a timing that the banknote P is clamped by the rubber rollers 37*a*, 38*a* and 37*b*, 38*b* of the second correction mechanism 33.

Figure 5:
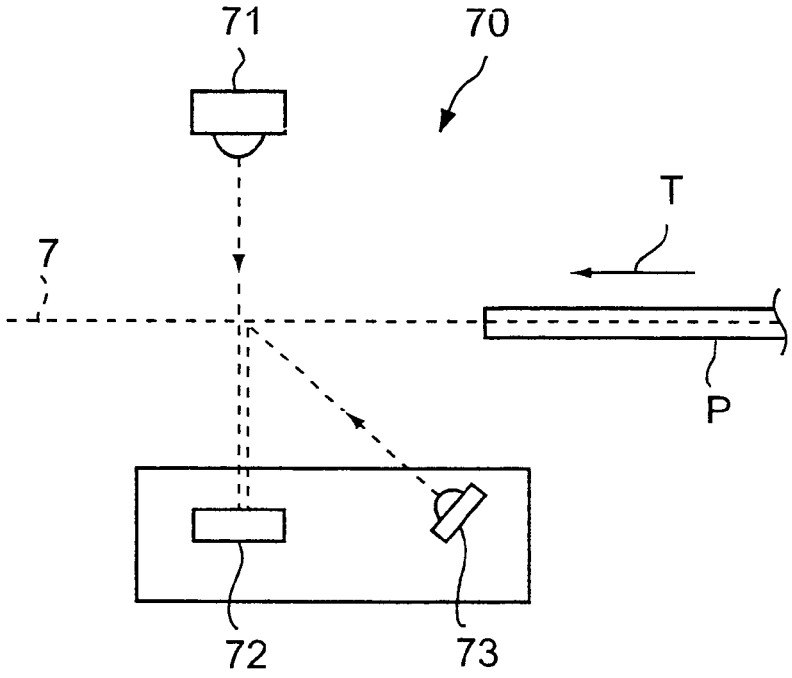
FIG. 5 is a schematic diagram for explaining the structure of a posture detecting sensor incorporated in the posture correction device shown in FIG. 2.

A posture detecting sensor 70 has a luminescent element 71 that is an LED, etc. provided above the conveying path 7 and a light receiving element 72 that is a photo-diode, etc. provided below the conveying path 7 as shown in FIG. 5. Plural luminescent elements 71 are arranged side by side in the cross direction (the direction of the banknote surface) orthogonal to the conveying direction and the same number of light receiving elements are also provided side by side. These plural luminescent elements 71 and light receiving elements are positioned so that the passing positions (see FIG. 4) of plural optical axes of these elements to pass the conveying path 7 are aligned in the direction orthogonal to the conveying direction T. And a banknote P is detected when the light is intercepted by the banknote P conveyed on the conveying path 7.

Further, the posture detecting sensor 70 has plural luminescent elements 73 provided below the conveying path 7. These plural luminescent elements 73 in the same number of units as the above-mentioned light receiving elements 72 are provided in parallel with the light receiving elements 72 in one united unit with the light receiving elements 72. The lights emitted from these luminescent elements 73 are reflected from the lower surface of a banknote P being conveyed on the conveying path 7 and led to the corresponding light receiving elements 72.

That is, the posture detecting sensor 70 detects the leading edge of a banknote P in the conveying direction; that is, one of the longer sides of a banknote P when the light is intercepted by a banknote P being conveyed on the conveying path 7. Then, based on this detected result, the length of the longer side, a skew angle and a shift amount of the banknote P are calculated by a posture correction controller 97.

Further, the posture detecting sensor 70 detects a reflection pattern based on the reflecting light from a banknote P and detects a kind, directions of front/back and top/bottom, bending, cut, break, etc. of the banknote P from the detected reflection pattern.

In this embodiment, the posture detecting sensor 70 is divided into two parts symmetrically at the center line 7*a* of the conveying path 7 as shown in FIG. 4.

Figure 6:
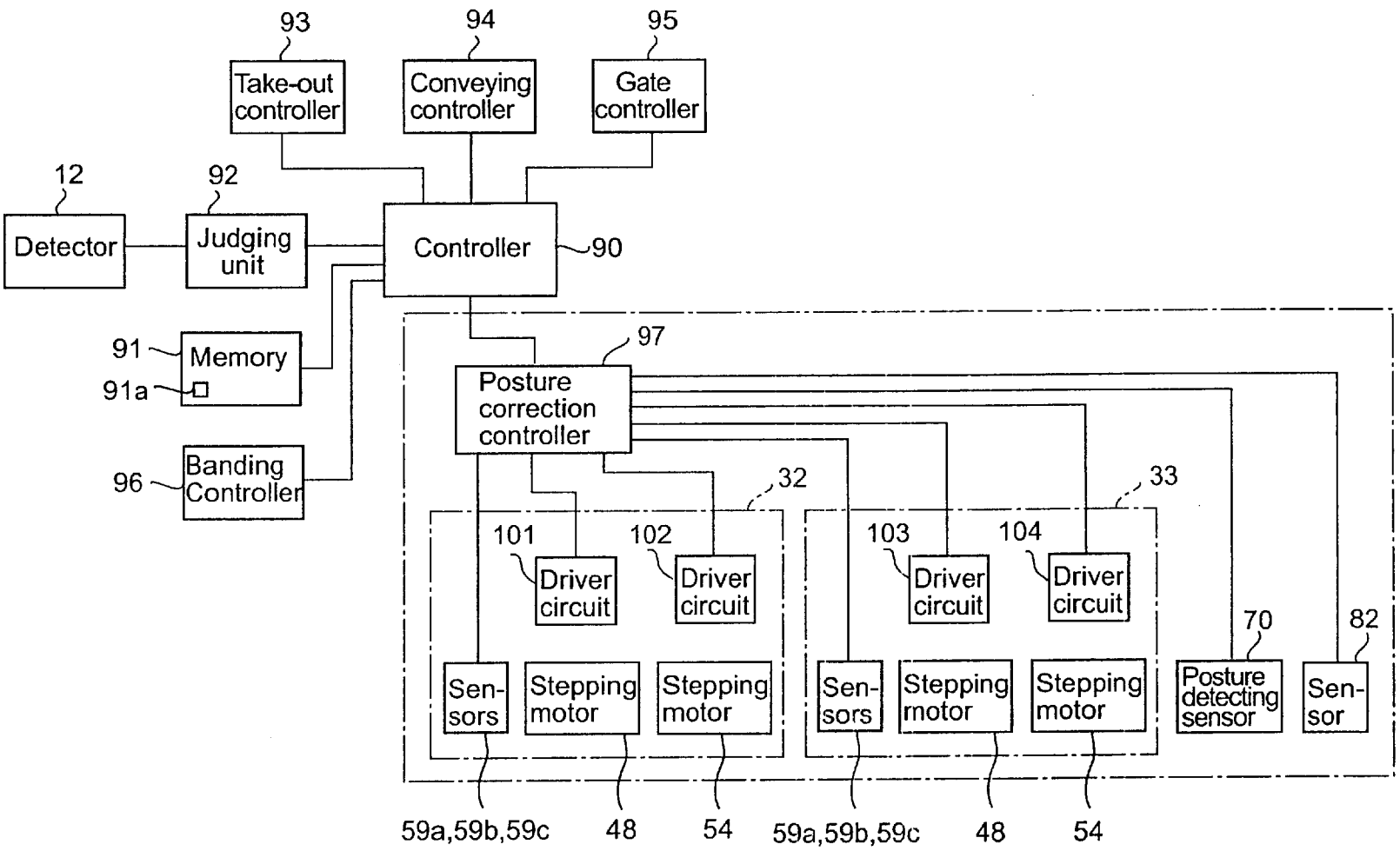
FIG. 6 is a block diagram of a control system for controlling the operation of the banknote receiving machine.

FIG. 6 shows a block diagram of a control system for controlling the operation of the banknote receiving machine 1 described above.

The control system of the banknote receiving machine 1 is composed of a controller 90, a memory 91, a judging unit 92, a take-out controller 93, a conveying controller 94, a gate controller 95, a banding controller 96, and the posture control device 11 having a posture correction controller 97.

The controller 90 controls the entire operation of the banknote receiving machine according to a preset operation program.

The memory 91 is used for storing an operation program and data.

The judging unit 92 judges whether the banknotes P can be circulated again, are of specific kind designated for banding, and the front/back and top/bottom of the banknotes P based on the detected result of the detector, and outputs the respective judging results to the controller 90.

The take-out controller 93 rotates the take-out rollers 6 under the control of the controller 90.

The conveying controller 94 rotates the conveying rollers by the conveying path 8 under the control of the controller 90. The conveying controller 94 moves and controls 3 pairs of the conveyor belts 49*a*, 49*b* and 49*c* at a fixed speed.

The gate controller 95 drives the gates G1~G3 and G5~G9 under the control of the controller 90.

The banding controller 96 executes the bandidng process under the control of the controller 90.

The posture correction controller 97 controls the posture correction device 11. A detection signal from the posture detecting sensor 70, detection signals from the sensors 59*a*, 59*b* and 59*c* of the first correction mechanism 32, detection signals from the sensors 59*a*, 59*b* and 59*c* of the second correction mechanism 33 and a detection signal from the sensor 82 are supplied to the posture correction controller 97.

Further, the posture correction controller 97 is connected with driver circuits 101 and 102 for rotating the stepping motors 48 and 54 of the first correction mechanism 32 and driver circuits 103 and 104 for rotating the stepping motors 48 and 54 of the second correction mechanism 33.

The posture correction controller 97 judges a skew amount (a skew amount in the conveying direction of banknote P, a skew angle $\alpha$ [°]) $\alpha$, a shift amount $\Delta S$ from the center position of the conveying path 7 (the center line, a prescribed position) 7*a* [mm] and a length of the conveying direction of banknote P (the length of the shorter side of banknote P [mm]) l as the conveying state of banknote P conveyed into the posture correction device 11 through the conveying path 7 according to the signals from the posture detection sensor 70 as shown in FIG. 4.

The position correction controller 97 judges the shift amount of the conveying position, a skew amount and a length of conveying direction of banknote P conveyed according to the detected signals from the posture detection sensor 7. The posture detection controller 97 judges the position of the first correction mechanism; that is, the current position of the drive shaft 35 according to the detection outputs from the sensors 59*a*, 59*b* and 59*c* of the second correction mechanism 33.

The posture correction controller 97 calculates a driving angle of the drive shaft 35 of the first correction mechanism using the shift amount of conveying position, the skew amount, the length of conveying direction of banknote P and a space between the rubber rollers 37*a* and 37*b* of the first correction mechanism 32 as parameters based on the shift amount of the conveying position, the skew amount and the length of the conveying direction of banknote P. The rotation of the drive shaft 35 is controlled based on this calculated driving angle and the current position of the drive shaft 35 of the first correction mechanism.

The posture correction controller 97 calculates the number of revolutions Q of the rubber rollers 37*a* and 37*b* of the first correction mechanism 32 based on the calculated driving angle described above. By controlling the rotation of the stepping motor 54 according to this calculated number of revolutions Q, the rubber rollers 37*a* and 37*b* of the first correction mechanism 32 are rotated.

Assuming the conveying speed (the periphery speed of the belts) of banknote P by the conveyor belts 49*a*, 49*b* and 49*c* at Y (see FIG. 7), the driving angle at $\theta$ (see FIG. 7), the radius of the rubber rollers 37*a* and 37*b* at r and the circular constant at $\pi$, the number of revolutions Q of the rubber rollers 37*a* and 37*b* are calculated according to the following formula:

$$Q=Y/2\pi r \cos\theta$$

The posture correction controller 97 calculates the number of revolutions Q' of the rubber rollers 37*a* and 37*b* of the second correction mechanism 33 based on the detected skew amount. The rubber rollers 37*a* and 37*b* of the second correction mechanism 33 are rotated by controlling the rotation of the stepping motor 54 according to this calculated number of revolutions Q'.

Assuming the conveying speed (the periphery speed of the belts) of banknote P by the conveyor belts 49*a*, 49*b* and 49*c* at Y, the skew amount $\alpha$, the radius of the rubber rollers 37*a* and 37*b* at r and the circular constant at $\pi$, The number of revolutions Q' of the rubber rollers 37*a* and 37*b* are calculated according to the following formula:

$$Q'=Y/2\pi r \cos\alpha$$

The posture correction controller 97 controls the rotation of the stepping motor 48 by an angle to be corrected based on the skew angle when detecting the leading edge of a banknote P being conveyed by the sensor 82, rotates the drive shaft 35 of the second correction mechanism 33. That is, at the timing when the leading edge of the banknote P passed the first correction mechanism 32 passes the sensor 82; that is, at the timing the banknote P is clamped by the rubber rollers 37*a*, 38*a* and 37*b*, 38*b* of the second correction mechanism 33, the drive shaft 35 of the second correction mechanism 33 is rotated by the angle α in the direction of the arrow 83 in the figure. Thus, the rotation of the drive shaft 35 of the second correction mechanism 33 in the state of the banknote P clamped by the rubber rollers 37*a*, 38*a* and 37*b*, 38*b* of the second correction mechanism 33 corrects the skew of the banknote P.

[First Embodiment]

Next, the correcting operation by the first correction mechanism 32 of the posture correction device 11 in the structure described above will be explained referring to FIG. 4 and FIG. 7 and a flowchart shown in FIG. 8.

Figure 7:
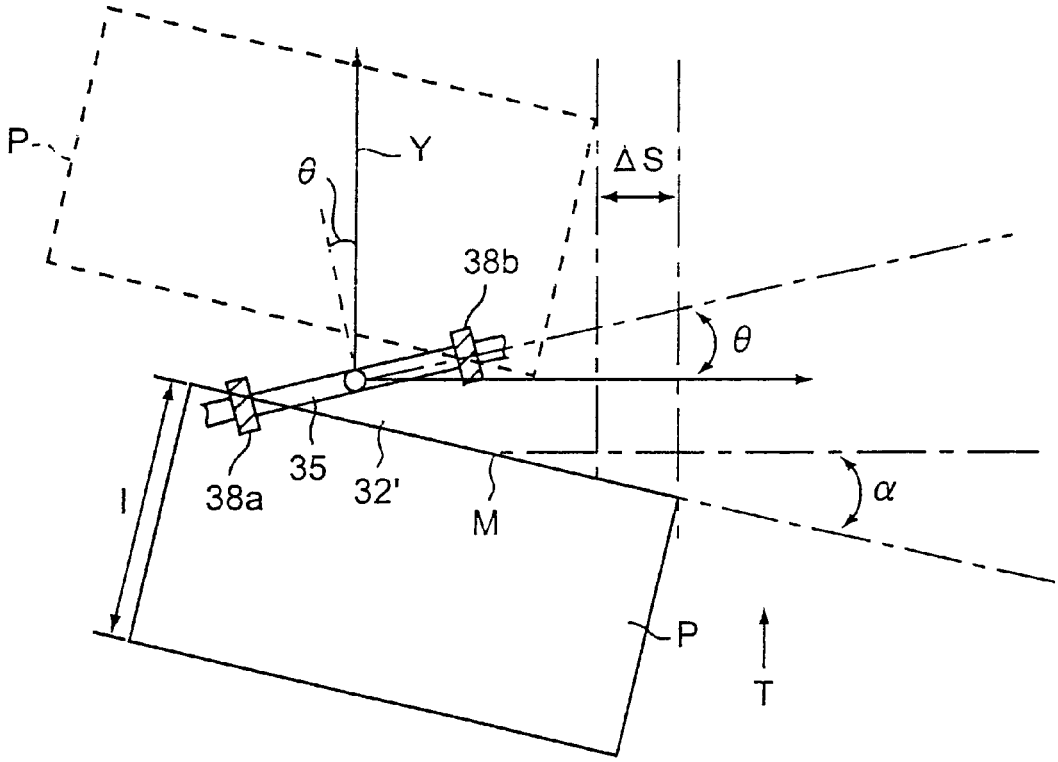
FIG. 7 is a diagram for explaining the correcting operation by a first correcting portion of the posture correction device.
Figure 8:
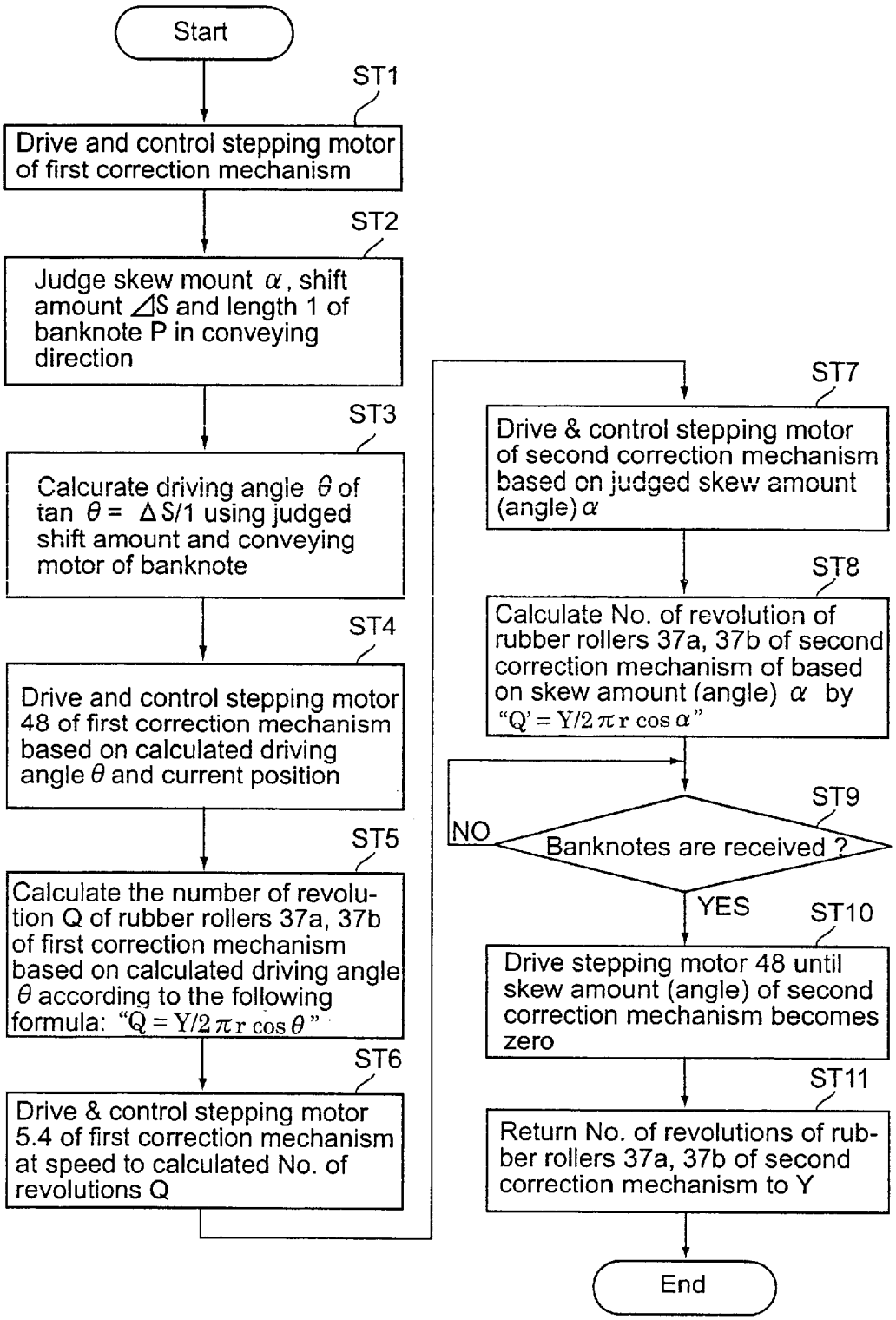
FIG. 8 is a flowchart for explaining the correcting operation by the first correction portion of the posture correction device.

Now, it is assumed that the skew a and the shift ΔS show at the level shown by the solid line in FIG. 7 are caused on a banknote P conveyed to the first correction mechanism through the conveying path 7.

Under this state, when judging the feeding of a banknote P (Pa) to the first correction mechanism 32 by a detection signal from a sensor (not shown) on the conveying path 7, the controller 90 outputs a control signal to the posture correction controller 97. Then, the posture correction controller 97 drives and controls the stepping motor 54 of the first correction mechanism 32 (ST 1). As a result, the rubber rollers 37*a*, 37*b*, 38*a* and 38*b* of the first correction mechanism 32 are rotated in the conveying direction at a peripheral speed equal to that of the conveyor belt pair 49*a*–49*c*.

Further, when the banknote P passes the posture detecting sensor 70, a detection signal is output from the posture detecting sensor 70 to the posture correction controller 97.

According to the detection signal from the posture detection sensor 70, the posture correction controller 97 judges the skew amount (a skew amount of a banknote P in the conveying direction, a skew angle α [°]), a shift amount ΔS [mm] from the center position (a prescribed position) 7*a* of the conveying path 7, and a length of the banknote P in the conveying direction [mm]) | as the conveying state of the banknote P fed into the posture correction device 11 through the conveying path 7 (ST 2).

The posture correction controller 97 calculates a driving angle θ; that is, tan θ=ΔS/| using the judged shift amount of conveying position, the skew amount and the length of conveying direction of the banknote P and the distance D of rubber rollers 37*a* and 37*b* (ST 3).

Namely, the driving angle θ fills following expressions:

$$t^4 + \frac{2}{\Delta S \cdot \cos\alpha}\{l + (D - \Delta S)\sin\alpha\} \cdot t^3 + \frac{4 \cdot D}{\Delta S} t^2 + \frac{2}{\Delta S \cdot \cos\alpha}\{l - (D + \Delta S)\sin\alpha\} \cdot t - 1 = 0$$

$$\theta = 2\tan^{-1} t$$

$$(|D \cdot \tan(\theta - \alpha)| + l/\cos(\theta - \alpha)) \cdot \sin\theta = \Delta S$$

or $$t^4 + \frac{2}{\Delta S \cdot \cos\alpha}\{l - (D + \Delta S)\sin\alpha\} \cdot t^3 - \frac{4 \cdot D}{\Delta S} t^2 + \frac{2}{\Delta S \cdot \cos\alpha}\{l + (D + \Delta S)\sin\alpha\} \cdot t - 1 = 0$$

-continued $$\theta = 2\tan^{-1} t$$

$$(|D \cdot \tan(\theta - \alpha)| + l/\cos(\theta - \alpha)) \cdot \sin\theta = \Delta S$$

Then, based on this calculated driving angle θ and the current position of the drive shaft 35 of the first correction mechanism 32, the posture correction controller 97 drives and controls the stepping motor 48 of the first correction mechanism 32 (ST 4). By this driving, the drive shaft 35 is rotated to the position of an angle to correct the drive shaft 35.

Further, at this time, the posture correction controller 97 calculates the number of revolutions Q of the rubber rollers 37*a* and 37*b* based on this calculated driving angle θ according to the following formula (ST 5):

$$Q = Y/2\pi r \cos\theta$$

The posture correction controller 97 controls the rotation of the stepping motor 54 at the number of revolutions corresponding to this calculated number of revolutions Q (ST 6). By this driving, the rubber rollers 37*a* and 37*b* of the first correction mechanism 32 are rotated.

As a result, when a banknote P (Pb) passes through the first correction mechanism 32, the moving speed of the banknote P and the speed of the rubber rollers 37*a*, 37*b*, 38*a* and 38*b* to the conveying direction of the banknote P (the speed component in the conveying direction of the banknote P out of the peripheral speed of the rubber rollers) agree with each other irrespective of the driving angle of the drive shaft of the first correction mechanism 32, and under this state, the banknote P is moved to correct the shift. At this time, the correction amount ΔS is decided according to an angle to the direction crossing the conveying direction of the drive shaft 35 and a time of banknote P conveyed by the rubber rollers 37*a*, 37*b*, 38*a* and 38*b*.

When the shift amount ΔS, the skew angle α and the shorter side length 1 of the banknote P are judged by the posture correction controller 97 as described above, in succession, θ that is, tan θ=ΔS/| is calculated in the posture correction controller 97. And the stepping motor 48 is rotated and controlled so as to drive the drive shaft 35 of the first correction mechanism 32 by the angle of this θ as shown by the arrow 81 in FIG. 4. At this time, the cylindrical shaft 43 of the first correction mechanism 32 and the shaft 44 are rotated in the reverse direction. However, as the one-way clutch 55 idles and the rotating speed of the first correction mechanism 32 does not change.

Further, it is possible to suppress the relative drop of the speed in the conveying direction of the banknote P by the rubber rollers 37*a*, 37*b*, 38*a* and 38*b* compared with the conveying speed of the banknote P (by the conveyor belts 49*a*–49*c*) with the change in the driving angle θ when the actual speed is made faster. That is, the number of revolutions are corrected for every driving angle of the drive shaft of the first correction mechanism 32.

When a banknote P is conveyed into the first correction mechanism 32 under this state, the banknote P is conveyed while clamped by the rubber rollers 37*a*, 37*b*, 38*a* and 38*b*. The banknote P being conveyed by the rubber rollers 37*a*, 37*b*, 38*a* and 38*b* is directed in the direction T' that is shifted by an angle θ to the center line 7*a* of the conveying path 7. At this time, the banknote P is directed in the direction of the arrow T' while maintaining the skew angle α and the shift of position in the cross direction only is corrected.

At this time, the moving speed of the banknote P and the speed of the rubber rollers 37*a*, 37*b*, 38*a* and 38*b* to the conveying direction of the banknote P agree with each other irrespective of he driving angle of the drive shaft 35 of the first correction mechanism 32 and the skew (of the posture) of the banknote P is not changed by the difference in the speeds and it becomes possible to make the highly accurate correction.

Figure 9:
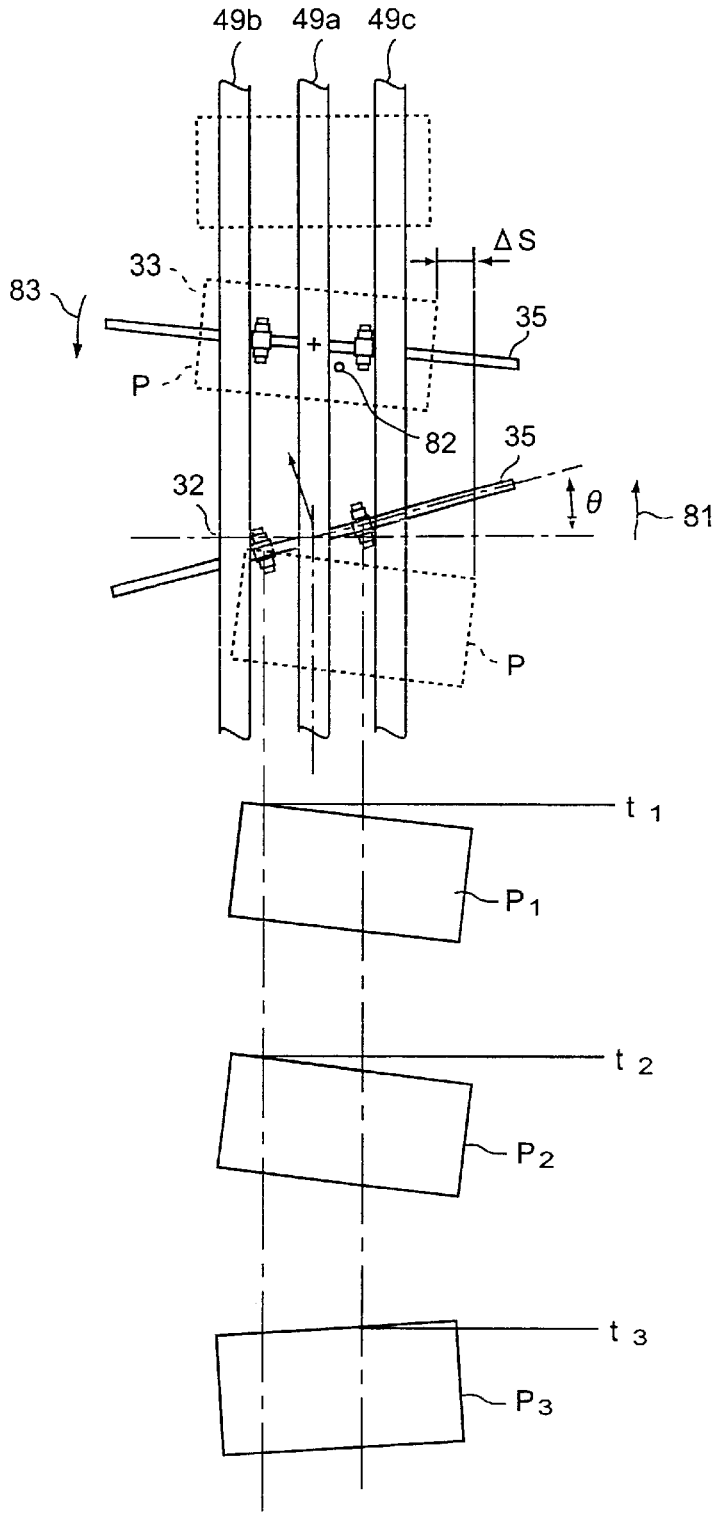
FIG. 9 is a plan view for explaining the correction process by the posture correction device.

It is the assumption that, for example, the swing angle of the drive shaft finishes the drive to the correction angle (the driving angle) when the banknotes are rushed in (t1, t2, t3, the conveying timings of banknotes P) and the conveying speeds of the rubber rollers 37*a*, 37*b*, 38*a* and 38*b* in the vertical direction are corrected for each swing angle of the drive shaft 35 when the banknotes P are further rushed in as shown in FIG. 9.

Thus, by adjusting the rotating speeds of the rubber rollers 37*a*, 37*b*, 38*a* and 38*b* to the swing angle of the drive shaft 35, it becomes possible to make the highly precise correction without changing the skew (the posture) of banknotes P.

Further, the posture correction controller 97 controls the driving of the stepping motor 48 of the second correction mechanism 33 based on the judged skew amount (angle) $\alpha$ of the banknotes P (ST 7). By this driving, the drive shaft 35 of the second correction mechanism 33 is rotated to the position of an angle to correct the skews (in the reverse direction of the arrow 83).

The posture correction controller 97 calculates the number of revolutions Q' of the rubber rollers 37*a* and 37*b* based on the skew amount (angle) a according to the following formula (ST 8):

$$Q'=Y\cos\alpha/2\pi r$$

The posture correction controller 97 controls the rotation of the stepping motor 54 at the number of revolutions corresponding to this calculated number of revolutions Q' and by this driving, the rubber rollers 37*a* and 37*b* of the second correction mechanism 33 are rotated.

As a result, when banknotes P are going into the second correction mechanism 33, the moving speed of the banknotes P and the speed of the rubber rollers 37*a*, 37*b*, 38*a* and 38*b* in the conveying direction of the banknotes P (the speed component in the conveying direction of the banknote P of the peripheral speed of the rubber rollers) agree with each other irrespective of the driving angle of the drive shaft 35 of the second correction mechanism 33.

Under this state, by a detection signal from the sensor 82, the posture correction controller 97 judges that banknotes P are received (ST 9).

According to this judgment, the posture correction controller 97 drives the stepping motor 45 until the skew amount (angle) of the second correction mechanism 33 becomes zero (ST 10). By this driving, the drive shaft 35 of the second correction mechanism 33 is rotated to the position of an angle 0 where the skew is corrected (in the direction of the arrow 83).

Then, the posture correction controller 97 controls the driving of the stepping motor 54 of the second correction mechanism 33 and rotates the rubber rollers 37*a*, 37*b*, 38*a* and 38*b* at a peripheral speed equal to those of the conveyor belt pair 49*a*–49*c*. That is, the number of revolutions of the rubber rollers 37*a* and 37*b* are returned to the conveying speed Y (ST 11).

As a result, at the timing when the leading edge of the banknote P passed the first correction mechanism 32 passed the sensor 82; that is, at the timing when the banknote P (Pc) is clamped by the rubber rollers 37*a*, 37*b*, 38*a* and 38*b* of the second correction mechanism 33, the second correction mechanism 33 is rotated by an angle $\alpha$ in the direction of the arrow 83 shown in the figure. Thus, the skew of the banknote P (Pd) is corrected as the second correction mechanism 33 is rotated under the state with the banknote P is clamped by the rubber rollers 37*a*, 37*b*, 38*a* and 38*b* of the second correction mechanism 33.

The banknotes P of which shift and skew are corrected continuously by a series of control operations described above are conveyed to the detector 12 at the downstream side as the banknotes P in the properly centered posture.

Further, out of banknotes P sent into the posture correction device 11, those banknotes without skew and shift are conveyed to the immediately behind detector 12 while kept in the proper posture without rotating the drive shafts 35 and 35 of the first and second correction mechanisms 32 and 33.

In this embodiment, the proper posture denotes the reference posture of a banknote P of which one side along the longitudinal direction is orthogonal to the center line 7*a* of the conveying path 7 and the center is positioned on the center line 7*a*.

As described above, it becomes possible to correct the shift and skew of banknotes precisely while keeping the banknote posture to the extend possible by avoiding such a problem that the speed drops in a moment when a banknote P enters into the correction arm rollers of the first and second correction mechanisms and the banknote posture is changed (skewed) as the collision is caused.

[Second Embodiment]

Next, whether the correction process should be executed or prohibited will be explained based on a gap between the preceding banknote P and a current banknote P in the posture correction device 11.

In this case, the posture correction controller 97 judges the trailing edge of a preceding banknote P and the leading edge of a current banknote P based on a detection signal from the posture detecting sensor 70, and based on this judgment, judges a gap (a space) between the preceding and the current banknotes P.

Further, a detection signal from the conveying detecting sensor(not shown) provided at the upper stream from the posture correction controller 97 on the conveying path 7 may be used instead of the detection signal from the posture detecting sensor 70.

Figure 10:
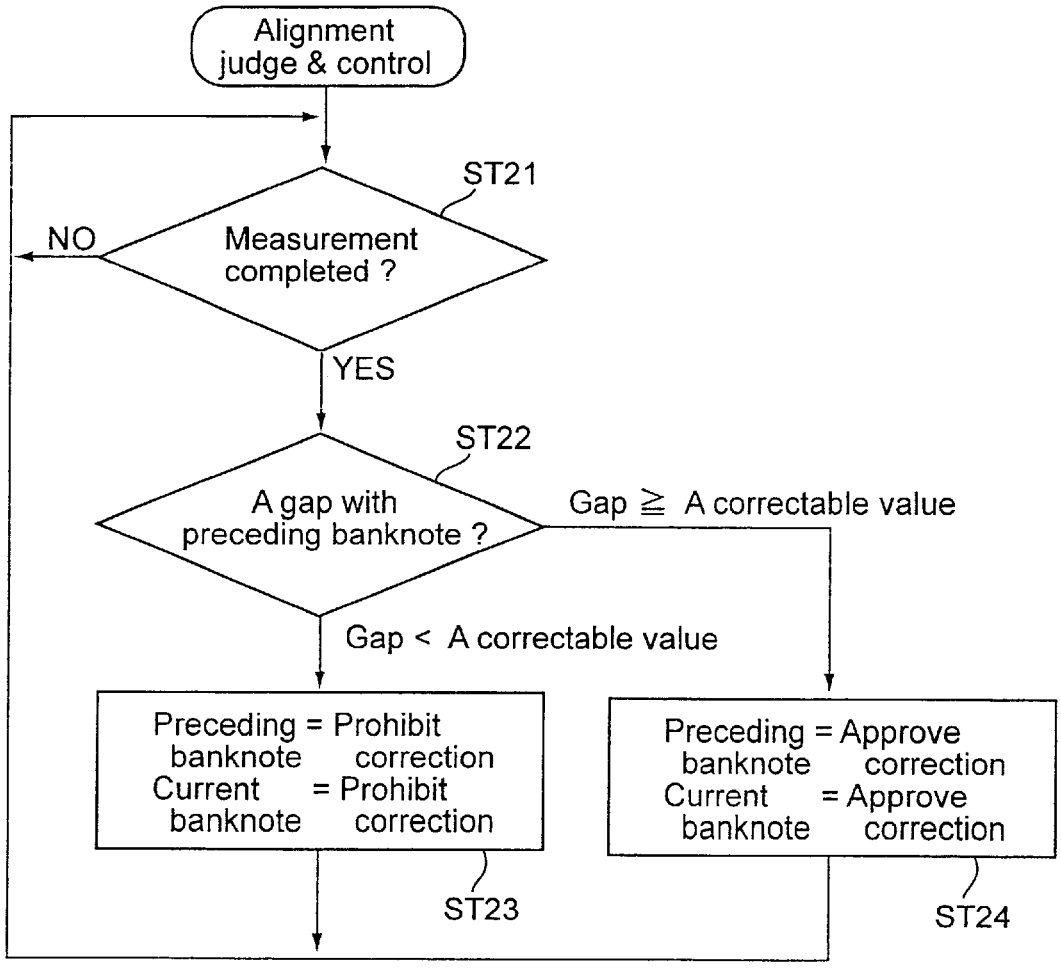
FIG. 10 is a flowchart for explaining the judging operation of the posture correction.

Next, the posture correction judging operation will be explained referring to a flowchart shown in FIG. 10.

Figure 11:
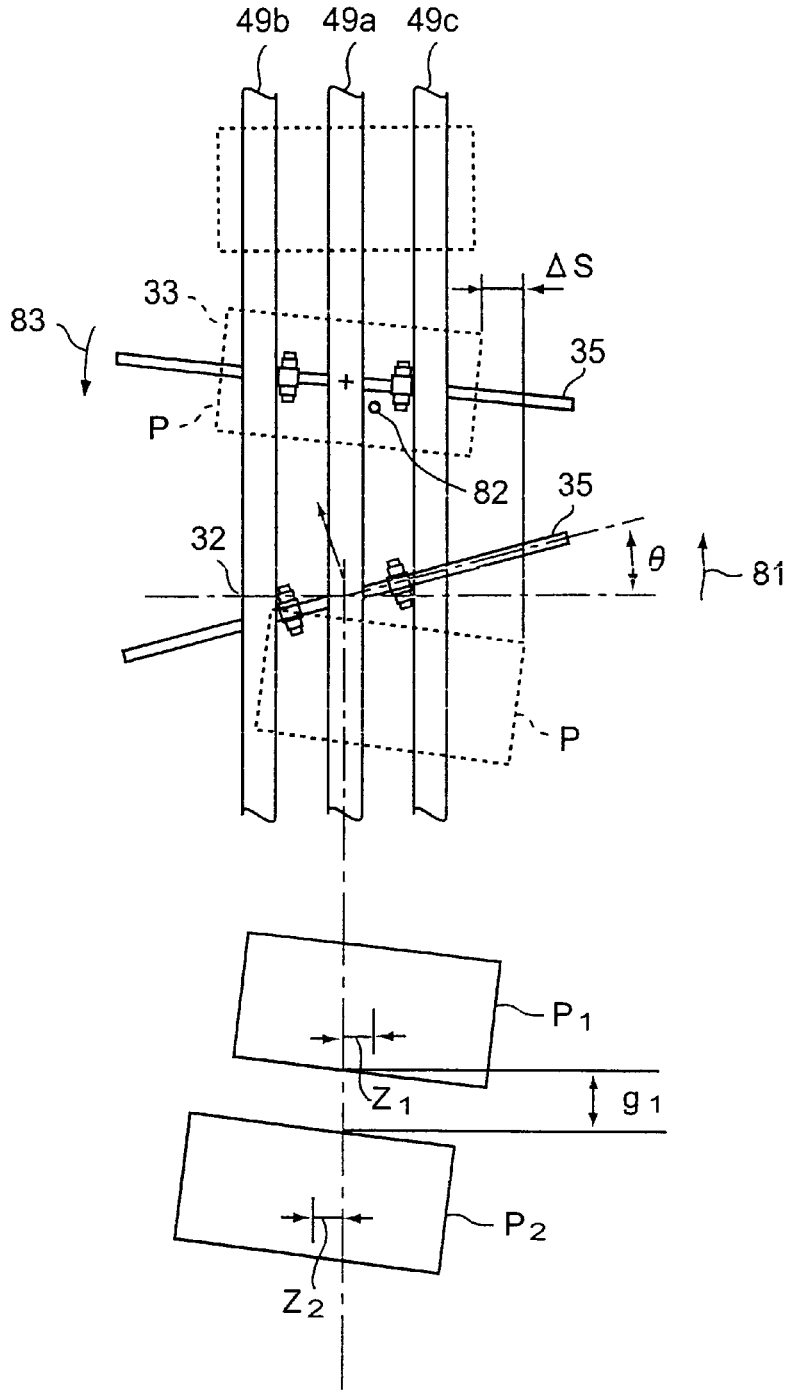
FIG. 11 is a plan view for explaining the state of banknotes successively conveyed to the posture correction device

First, as shown in FIG. 11, a case wherein a banknote P1 and a current banknote P2 are conveyed with a gap (space) g1 between them will be explained.

The posture correction controller 97 judges the trailing edge of the preceding banknote P1 and the leading edge of the current banknote P2 according to a detection signal from the posture detecting sensor 70, and judges a gap (space) g1 between the preceding banknote P1 and the current banknote P2 from the trailing edge of the preceding banknote P1 and the leading edge of the current banknote P2 (ST 21). Then, the posture correction controller 97 judges whether this gap g1 is larger than, equal to or smaller than a correctable value (ST 22). At this time, the posture correction controller 97 judges this gap g1 smaller than the correctable value and judges the prohibition of the posture correction for the preceding banknote P1 and the current banknote P2 (ST 23) and sets the drive shaft 35 of the first correction mechanism 32 and the drive shaft 35 of the second correction mechanism 33 at the parallel positions.

As a result, the preceding banknote P1 and the current banknote P2 pass through the posture correction device 11 without correcting the shift and skew.

Figure 12:
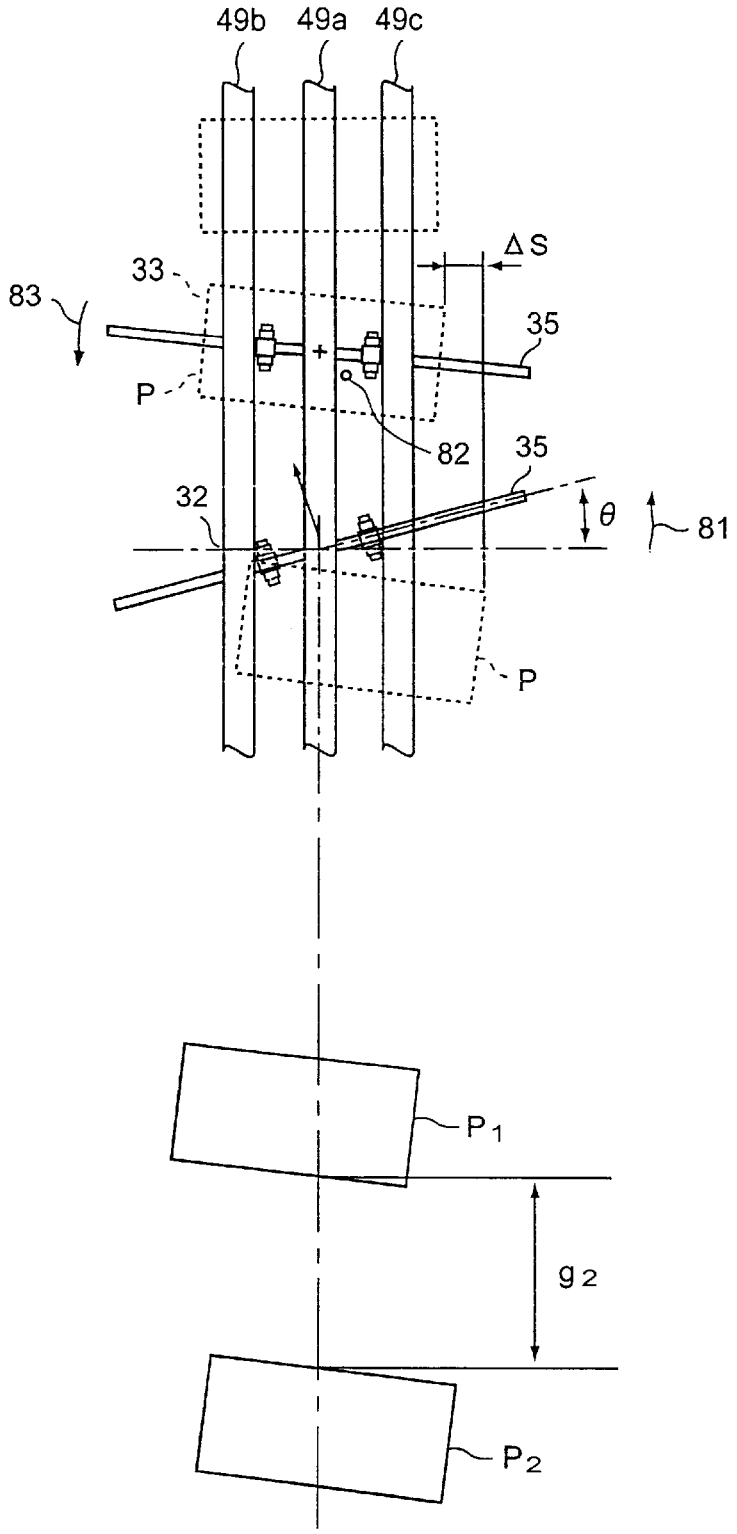
FIG. 12 is a diagram for explaining the state of banknotes successively conveyed to the posture correction device.

Next, a case wherein the preceding banknote P1 and the current banknote P2 are conveyed with a gap (space) g2 as shown in FIG. 12 will be explained.

The posture correction controller 97 judges the trailing edge of the preceding banknote P1 and the leading edge of the current banknote P2 according to the detection signal from the posture detecting sensor 70, and judges a gap (space) g2 between the preceding banknote P1 and the current banknote P2 by the trailing edge of the preceding banknote P1 and the leading edge of the current banknote P2 (ST21). Then, the posture correction controller judges whether this gap g2 is larger then, equal to or smaller than a correctable value (ST 22). At this time, the posture correction controller 97 judges this gap g2 larger than (equal to) a correctable value and judges to approve the posture correction of the preceding banknote P1 and the current banknote P2 (ST24), and the shift correction by the first correction mechanism 32 and the skew correction by the second correction mechanism 33 are executed.

FIG. 11 is a diagram showing a case wherein a banknote P taken in at a short pitch is sent into the posture correction device 11.

For the skew correction, drive the first correction mechanism 32 by a correction angle till the leading edge of a banknote P enters into the drive shaft 35 that functions as a skew correction arm. Then, by conveying the banknote P askew in the skew angle direction by the rubber rollers, correct the skew of the banknote P without changing the posture. Thereafter, the drive shaft 35 keeps the correction angle as long as the banknote P is on the rubber rollers.

Therefore, the timing for driving the drive shaft 35 is determined according to the gap between the trailing edge of the preceding banknote P and the leading edge of the succeeding banknote P2.

The limit for the skew correction of a closing banknote P is determined by the operating time of the drive shaft 35. As the drive shaft 35 is driven once for one sheet of banknote, after the correction, the drive shaft 35 is kept at the swing angle at the time when the correction was made until a succeeding banknote P comes.

A banknote P closing by exceeding this limitation cannot be corrected and it is necessary to prohibit the correction.

When the closing banknotes P1 and P2 are conveyed closely, if the banknote P1 was corrected, the banknote P2 cannot be corrected if the correcting limit was exceeded like the gap g1. Therefore, the banknote P2 is passed without correcting the skew with the swing angle that was used for correcting the banknote P1. When the shift from the center of the banknote P1 was Z1 and the shift from the center of the banknote P2 was Z2, the banknote P1 is corrected to the center position and the banknote P2 is shifted from the center position by Z1+Z2.

In FIG. 11 and FIG. 12, the gaps g1 and g2 between the preceding and current banknotes P1 and P2 are checked and when the gap g1 exceeded the correction limit, the drive shaft 35 of the first correction mechanism 32 is driven to the position parallel to the preceding banknote P1 and the correction of the closing banknotes P1 and P2 is prohibited. Thus, a succeeding banknote P is prevented from being shifted largely.

Accordingly, the correction of two sheets of banknotes that are closed to each other in excess the correction limit is prohibited. Thus, it becomes possible to solve a problem that a jam is caused when a preceding banknote is corrected, a succeeding banknote is shifted largely from the center if the preceding banknote is corrected.

[Third Embodiment]

Next, in the posture correction device 11, whether the shift correction process is to be performed based on the gap (space) between a preceding banknote P and a current banknote P and the direction of the shift of the banknotes P1 and P2 or the correction process is to be prohibited will be explained.

In this case, the posture correction controller 97 judges the trailing edge of the preceding banknote P1 and the leading edge of the current banknote P2 and based on this judgment, judges the gap (space) between the preceding banknote P1 and the current banknote P2.

Further, the posture correction controller 97 judges the shift amount ΔS based on a detection signal from the posture detecting sensor 70.

Figure 13:
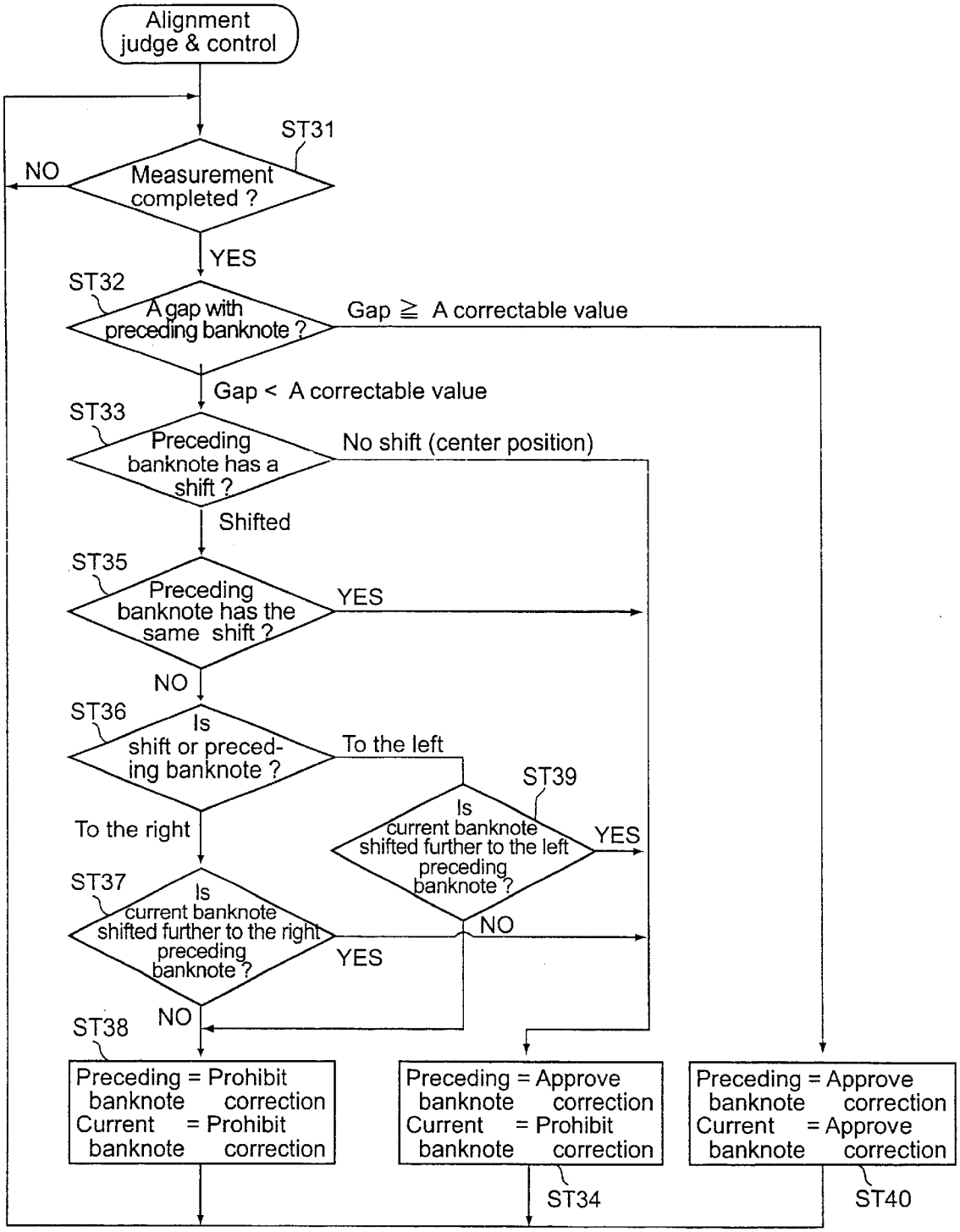
FIG. 13 is a flowchart for explaining the judging operation of the posture correction.

Then, the correcting operation will be explained referring to a flowchart shown in FIG. 13.

First, the posture correction controller 97 judges the trailing ends of the preceding banknote P1 and the leading edge of the current banknote P2 according to a detection signal from the posture detecting sensor 70, and judges a gap (space) between the preceding and the current banknotes P1 and P2 (ST 31). Then, the posture correction controller 97 judges whether this gap is larger than, equal to or smaller than a correctable value (ST 32). At this time, when judged this gap smaller than a correctable value, the posture correction controller 97 judges whether the preceding banknote P1 has the shift (ST 33).

As a result, when judged that the preceding banknote P1 has no shift and is positioned on the center of the conveying path 7, the posture correction controller 97 judges the approval of the posture correction for the preceding banknote P1 and the prohibition of the posture correction for the current banknote P2 (ST 34).

Thus, the shift correction of the preceding banknote P1 by the first correction mechanism 32 is not made and the skew correction is made by the second correction mechanism 33. The current banknote P2 passes the posture correction device without receiving the shift correction by the first correction mechanism 32 and the skew correction by the second correction mechanism 33 (without change).

Further, in the above STEP 33, when judged that the preceding banknote P1 has the shift, the posture correction controller 97 judges whether the shift direction and amount of the preceding banknote P1 are equal to those of the current banknote P2 (ST 35).

As a result, when judged that the direction and amount of shift of the preceding banknote P1 are equal to those of the current banknote P2, the posture correction controller 97 judges the approval of the posture correction for the preceding banknote P1 and the prohibition of the posture correction for the current banknote P2 (ST 34).

Thus, the preceding banknote P1 receives the shift correction by the rotation of the drive shaft 35 of the first correction mechanism 32 and the skew correction by the second correction mechanism 33. As the drive shaft 35 of the first correction mechanism 32 is kept in the state when the preceding banknote P1, the current banknote P2 receives the shift correction and passes without receiving the skew correction by the second correction mechanism 33.

Further, when judged that the direction and amount of the shift of the preceding banknote P1 are not the same as those of the current banknote P2 in the above step 33, the posture correction controller 97 judges whether the shift direction of the preceding banknote P1 is right or left (ST 36).

Then, when judged that the shift direction of the preceding banknote P1 is right, the posture correction controller 97 judges whether the current banknote P2 is shifted to the right further than the preceiding banknote P1 (ST 37).

As a result of this judgment, when judged that the current banknote P2 is shifted further to the right than the preceding banknote P1, the posture correction controller 97 judges the approval of the posture correction for the preceding banknote P1 and the prohibition of the posture correction for the current banknote P2 (ST 34).

Thus, the shift correction of the preceding banknote P1 by the rotation of the drive shaft 35 of the first correction mechanism 32 and the skew correction by the second correction mechanism are made. The drive shaft 35 of the first correction mechanism 32 is kept in the state when the preceding banknote P1 was processed, the current banknote P2 receives the shift correction and passes the posture correction device without receiving the skew correction by the second correction mechanism 33.

Further, when judged that the current banknote P2 is not shifted to the right furthermore the preceding banknote P1 in Step 37, the posture correction controller 97 judges the prohibition of the posture correction for the preceding banknote P1 and the current banknote P2 (ST38) and sets the drive shafts 35 of the first correction mechanism 32 and that of the second correction mechanism 33 at the positions parallel to each other.

As a result, the preceding banknote P1 and the current banknote P2 pass through the posture correction device 11 without the shift and skew corrections.

Further, when judged that the preceding banknote P1 is shifted to the left in Step 36, the posture correction controller 97 judges whether the current banknote P2 is further shifted to the left from the preceding banknote P1 (ST 39).

As a result, when judged that the current banknote P2 is shifted to the left furthermore the preceding banknote P1, the posture correction controller 97 judges the approval of the posture correction for the preceding banknote 1 and the prohibition of the posture correction for the current banknote P2 (ST 34).

Thus, the shift correction by the rotation of the drive shaft 35 of the first correction mechanism 32 and the skew correction by the second correction mechanism 33 are made for the preceding banknote P1. The drive shaft 35 of the first correction mechanism 32 is kept in the state of processing the preceding banknote P1, the shift correction is made for the current banknote P2 and passes through the posture correction device 11 without the skew correction by the second correction mechanism 33.

Further, when judged that the current banknote P2 is not shifted to the left further the preceding banknote P1 in Step 39, the posture correction controller 97 judges the prohibition of the posture correction for the preceding banknote P1 and the current banknote P2 (ST 38) and sets the drive shaft 35 of the first correction mechanism 32 and the drive shaft 35 of the second correction mechanism 33 at the positions parallel to each other.

As a result, the preceding banknote P1 and the current banknote P2 pass through the posture correction device 11 without the shift and skew correction.

Further, when judged that the gap is larger than (equal to) a correctable value in the above Step 32, the posture correction controller 97 judges the approval of the posture correction for the preceding banknote P1 and the current banknote P2 (ST 40) and the shift correction by the first correction mechanism 32 and the skew correction by the second correction mechanism are made.

When the measuring of the current banknote P2 is completed, for example, when the preceding banknote P1 is shifted by Z1 to the right from the center in FIG. 11, the result of the gap g1 and the shift from the center are obtained. When the gap is a correctable value, the correction of the preceding banknote P1 and the current banknote P2 is approved and the correction is made.

When the gap g1 is smaller than the correction limit as shown in FIG. 11, if the preceding banknote P1 is shifted to the right by Z1, the drive shaft(the correction arm) 35 is tilted to the left by an angle θ in order to correct the shift to the center position if the preceding banknote P1 is corrected.

When the preceding banknote P1 is shifted to the right by Z1, if the current banknote P2 is shifted to the right from this position of Z1 as the reference, the current banknote P2 is corrected to the right from the center by a difference from Z1 by correcting the preceding banknote P1 according to the process in Step 34 shown in the flowchart and by processing the current banknote P2 without correcting in the state of the arm angle for corrected the preceding banknote P1.

Conversely, when the current banknote P1 is shifted to the left from the position of Z1 (FIG. 11), the current banknote P2 that is shifted to the left is further shifted to the left and therefore, by setting the correction arms at the parallel positions by the process in Step 38 of the flowchart, perform the process to pass he preceding and current banknotes without making the correction.

When the preceding banknote P1 is shifted to the left, the banknote P1 is processed by replacing the left and right in the process described above.

As described in detail in the above, according to this invention, it is possible to provide a paper-like materials processing apparatus that is capable of bringing the speed of shift correction rollers for moving paper-like materials in the conveying direction at an angle based on the shift amount crossing the conveying direction of paper-like materials in agreement with the conveying speed by a conveying means and preventing the posture of paper-like materials from being changed by the shift correction rollers.

In addition, it is possible to provide a paper-like materials processing apparatus capable of prohibiting the correction of the posture of paper-like materials that are close to each other in excess of the limit for the posture correction and preventing the expansion of shift of succeeding paper-like materials.

What is claimed is:

1. A sheet materials processing apparatus comprising:

conveying means for conveying sheet materials along a conveying path;

first detecting means for detecting a shift amount of sheet materials being conveyed by the conveying means in the direction crossing the conveying direction;

moving means following the detecting means along the conveying path, provided with a supporting arm supported at the center of the conveying path and shift correction rollers disposed on the supporting arm for moving sheet materials being conveyed by the conveying means in the direction crossing the conveying path;

first calculating means for calculating a driving angle of the support arm based on a shift amount from a prescribed position detected by the first detecting means;

second calculating means for calculating a number of revolutions of the shift correction rollers so that a speed component out of the peripheral speed of the shift correction rollers in the conveying direction of sheet materials becomes equal to a conveying speed by the shift correction rollers;

support arm rotating means for rotating the support arm of the moving means based on the driving angle calculated by the first calculating means;

correction roller rotating means for rotating the shift correction rollers of the moving means based on the number of revolutions calculated by the second calculating means; and first correcting means for correcting the shift from a prescribed position of the sheet materials by moving the sheet materials that are conveyed by the conveying means in the direction crossing the conveying path in the state with the support arm of the moving means rotated in the direction crossing the conveying path by the support arm rotating means and in the state with the shift correction rollers of the moving means being rotated at the number of revolutions by the correction roller rotating means.

2. The sheet materials processing apparatus according to claim 1, wherein the first detecting means includes means for detecting a skew amount of sheet materials to the conveying direction; and the correcting means is provided at the latter stage of the moving means on the conveying path and includes means for correcting the skew in the direction crossing the conveying direction of the sheet materials by rotating the sheet materials conveyed by the conveying means by the support arm rotating means by the driving angle to offset the skew amount in the conveying direction of the sheet materials detected by the detecting means.

3. The sheet materials processing apparatus according to claim 1, further comprising:

second detecting means provided at the latter state of the moving means on the conveying path for detecting features of sheet materials being conveyed on the conveying path; and classifying means provided at the latter stage of the second detecting means for classifying sheet materials conveyed on the conveying path based on the features of sheet materials detected by the second detecting means.

4. The sheet materials processing apparatus according to claim 1, wherein the number of revolutions Q of the shift correction rollers is as follows:

$$Q=Y/2\pi r \cos\theta$$

where, Y is the conveying speed of the conveying means, θ is the driving speed of the shift correction rollers, r is the radius of the shift correction rollers, and π is the circular constant.

5. A sheet materials processing apparatus comprising:

conveying means for conveying sheet materials in order consecutively along a conveying path;

first detecting means for detecting shift amounts of preceding sheet materials conveyed in order by the conveying means to either left and right directions crossing the conveying direction, skew amounts in the direction crossing the conveying direction of paper-like materials, and a gap of preceding and current sheet materials;

first correcting means for correcting the shift and skew in the direction crossing the conveying direction based on the shift and skew amounts detected by the detecting means for the preceding and current sheet materials when a gap between the preceding and current sheet materials detected by the first detecting means is more than a prescribed gap; and prohibiting means for prohibiting the correction of shift and skew for the preceding and current sheet materials being conveyed by the conveying means when a gap between the preceding and current sheet materials detected by the first detecting means are less than the prescribed gap.

6. The sheet materials processing apparatus according to claim 5, further comprising:

second correcting means for correcting the shift and skew in the direction crossing the conveying direction based on the shift and skew amounts detected by the first detecting means for the preceding sheet materials being conveyed by the conveying means when a gap between the preceding and current sheet materials detected by the first detecting means is less than the prescribed gap and the shift directions of the preceding and current sheet materials detected by the detecting means are the same or there is no shift.

7. The sheet materials processing apparatus according to claim 5, wherein the prohibiting means prohibits the correction of shift and skew of the preceding and current sheet materials conveyed by the conveying means when a gap between the preceding and current sheet materials detected by the first detecting means is less than the prescribed gap and the shift directions of the preceding and current sheet materials detected by the first detecting means are different.

8. The sheet materials processing apparatus according to claim 5, further comprising:

second detecting means for detecting features of sheet materials corrected by the correcting means or sheet materials prohibited for the correction by the prohibiting means; and classifying means for classifying the sheet materials conveyed by the conveying path based on the features of the sheet materials detected by the second detecting means.

9. The sheet materials processing apparatus according to claim 6, further comprising:

second detecting means for detecting features of the sheet materials corrected by the first correcting means or the sheet materials corrected by the second correcting means or the sheet materials prohibited by the prohibiting means for the correction; and classifying means for classifying sheet materials conveyed by the conveying means based on the features of the sheet materials detected by the second detecting means.

10. A sheet materials processing apparatus comprising:

conveying means for conveying sheet materials along a conveying path;

detecting means provided on the conveying path for detecting the skew of the sheet materials conveyed by the conveying means in the direction crossing the conveying direction;

rotating means provided at the latter stage of the detecting means on the conveying path, provided with a support arm at the center of the conveying path and a skew correcting roller provided to the support arm for correcting the skew of sheet materials conveyed by the conveying means in the direction crossing the conveying path;

first calculating means for calculating a driving angle of the support arm based on a skew amount in the direction crossing the conveying direction detected by the detecting means;

second calculating means for calculating number of revolutions of the skew correcting rollers so that a speed component for the conveying direction of sheet materials out of the peripheral speed of the skew correcting rollers becomes equal to the conveying speed by the conveying means accompanied with the change in the driving angle calculated by the first calculating means; and correcting means for rotating the support arm based on the driving angle calculated by the first calculating means, receiving sheet materials by rotating the skew correcting rollers based on the number of revolutions calculated by the second calculating means and correcting the skew in the direction crossing the conveying direction of the sheet materials by the driving angle to offset the skew amount in the direction crossing the conveying direction of the sheet material detected by the detecting means.

11. The sheet materials processing apparatus according to claim 10, wherein the correcting means has means for returning the number of revolutions of the skew correcting rollers to the speed equal to the conveying speed by the conveying means after receiving sheet materials.

* * * * *